US007138092B2

(12) United States Patent
Carroll et al.

(10) Patent No.: US 7,138,092 B2
(45) Date of Patent: Nov. 21, 2006

(54) CLIP-MOUNTED CATALYST DEVICE

(75) Inventors: Joseph Allen Carroll, Lilburn, GA (US); Robert L. Mitchell, Atlanta, GA (US)

(73) Assignee: Realist Technology Ltd., Atlanta, GA (US)

( * ) Notice: Subject to any disclaimer, the term of this patent is extended or adjusted under 35 U.S.C. 154(b) by 692 days.

(21) Appl. No.: 09/827,473

(22) Filed: Apr. 6, 2001

(65) Prior Publication Data

US 2002/0146355 A1 Oct. 10, 2002

(51) Int. Cl.
*B01D 50/00* (2006.01)
*F24C 15/20* (2006.01)

(52) U.S. Cl. ..... 422/177; 422/180; 126/299 R

(58) Field of Classification Search ..... 126/299 R, 126/312, 307, 203, 289, 285 R, 77, 123; 422/180

See application file for complete search history.

(56) References Cited

U.S. PATENT DOCUMENTS

| | | | | |
|---|---|---|---|---|
| 3,536,457 | A * | 10/1970 | Henderson | 422/114 |
| 3,785,778 | A * | 1/1974 | Burstein et al. | 422/171 |
| 4,437,451 | A * | 3/1984 | Wysong | 126/77 |
| 5,285,640 | A * | 2/1994 | Olivo | 60/274 |
| 5,934,268 | A * | 8/1999 | Onocki | 126/512 |

FOREIGN PATENT DOCUMENTS

| | | |
|---|---|---|
| DE | 199 12 453 A | 9/2000 |
| EP | 0 831 277 A1 | 3/1998 |
| FR | 2 739 791 A | 4/1997 |
| GB | 1 204 423 | 9/1970 |
| JP | 55096820 | 7/1980 |
| JP | 62237930 | 10/1987 |

* cited by examiner

*Primary Examiner*—Glen Caldarola
*Assistant Examiner*—Tom Duong
(74) *Attorney, Agent, or Firm*—Sutherland Asbill & Brennan LLP

(57) ABSTRACT

A catalytic converter device for use with a device such as an oven is provided. The catalytic converter device includes a catalyst-coated ceramic substrate and a mounting ring. The mounting ring secures the ceramic substrate and is engagable with one or more surfaces of a vent of the oven to secure the catalytic converter within an orifice of the vent such that gases flowing through the vent will pass through the apertures of the substrate. The mounting ring includes a body in the shape of a ring, one or more retaining tabs extending from the body which secure the ceramic substrate within the ring about the circumferential surface of the ceramic substrate, and one or more locking tabs extending from the body. The one or more locking tabs allow the mounting ring to be slid or snapped into place in the vent orifice, thereby eliminating the need to secure the catalytic converter device using screws.

23 Claims, 4 Drawing Sheets

CLIP-MOUNTED CATALYST DEVICE

FIELD OF THE INVENTION

The devices and methods described herein are generally in the field of catalytic converter-type smoke eliminators, such as found in self-cleaning ovens.

BACKGROUND OF THE INVENTION

Self-cleaning ovens clean by heating the oven above normal cooking temperatures to burn off and eliminate the residues created in the oven during normal cooking. The organic cooking residues oxidize and evolve as smoke and vapors, which comprise volatile organic compounds (VOCs) and particulate matter. Standard commercially-available ovens include catalytic converters. These catalytic converters complete the oxidation process, converting the evolved smoke and vapors into carbon dioxide and water, thereby preventing smoke and odors from escaping into the kitchen during the self-cleaning cycle.

Standard catalytic converters for self-cleaning ovens normally include a catalyst coated ceramic honeycomb-shaped disk. These coated ceramic disks are positioned within the oven's exhaust conduit or vent, through which the hot smoke and VOCs pass. The disks, typically 1¼" to 2" in diameter and ½" thick, are mounted in a flanged, cylindrical metal tube (or can), roughly 1" to 5" long, with impingement-crimped restraints on both sides of the disk. A metal sealing ring optionally is provided around the top circumference of the ceramic disk, forming a seal between the interior wall surface of the metal tube and the outer circumferential surface of the ceramic disk, to reduce gas bypass. The sealing ring also protects the ceramic disk from fracture during the crimping process, as the ring is interposed between the top surface of the ceramic disk and the notches of the impingement-crimped restraints. The flanged tube, which serves as at least a portion of the exhaust vent, is then mounted with screws into the kitchen range in communication with the self-cleaning oven. The cylindrical can design, however, does not fit in some designs of kitchen ranges, such as those wherein the exhaust vents have sharp bends or those using "flat"-shaped exhaust vents. In some range or oven designs, the standard cylindrical tube and/or the ½ inch thick disk will not fit. Moreover, installation of the metal can using screws is labor-intensive and costly.

Another design of catalytic converter includes catalyst coated metal screens mounted in a metal tube, much like the ceramic substrate is. The mounting is then attached with screws into an exhaust vent assembly. The coated screens, however, generally are inferior to the coated ceramics, as the screens typically will lose catalyst efficiency after far fewer self-cleaning cycles than the coated ceramics. The problem with the coated screens stems from the mismatch between the thermal expansion of the ceramic-based catalyst coating and the thermal expansion of metal wires, which over repeated thermal cycles leads to peeling off of the coating. A ceramic substrate, in contrast, minimizes the thermal expansion mismatch and would be preferred. Coalescing of the catalytic metals may be another problem with using screens. Thus it would be advantageous to be able to use a ceramic substrate catalyst in a variety of self-cleaning oven applications, particularly those where the exhaust vents are narrow or have sharp bends.

It is therefore an object of the present invention to provide a catalytic converter device including a catalyst-coated ceramic substrate, wherein the device can be easily mounted in a self-cleaning oven, including standard ovens and those ovens having flat shaped exhaust vent tubes.

It is a further object of the present invention to provide methods for installing such catalytic converter devices in an oven without the need for screws.

These and other objects, features, and advantages of the present invention will become apparent upon review of the following detailed description of the invention when taken in conjunction with the drawings and the appended claims.

SUMMARY OF THE INVENTION

A catalytic converter device is provided for use with an oven, particularly the self-cleaning ovens of kitchen ranges, and other devices or systems in which catalytic conversion of a flue gas is desirable. The catalytic converter device includes a catalyst, a ceramic substrate, and a mounting ring. The ceramic substrate has a first surface, a second surface, a circumferential surface, and a plurality of apertures extending through the substrate from the first surface to the second surface. The ceramic substrate is coated with a coating material that includes a catalyst, preferably a noble metal catalyst. The mounting ring secures the ceramic substrate and is engagable with one or more surfaces of a vent to secure the catalytic converter within an orifice of the vent such that gases flowing through the vent will pass through the apertures of the substrate. The mounting ring includes a body in the shape of a ring, one or more retaining tabs extending from the body which secure the ceramic substrate within the ring about the circumferential surface of the ceramic substrate, and one or more locking tabs extending from the body. The locking tabs allow the mounting ring to be secured, such as by being clipped, into place in the vent orifice, thereby eliminating the need to secure the catalytic converter device using screws.

In a preferred embodiment, the ceramic substrate is in the shape of a round disk, preferably having a thickness of between about 1/32" and about ½", more preferably between about ⅛" and about ¼", and preferably having a diameter of between about ½" and about 2", more preferably between about 1" and about 1⅝".

In a preferred embodiment, the noble metal catalyst is platinum, palladium, or a mixtures thereof. The mounting ring preferably is a metal, such as a stainless steel, aluminum, or aluminized steel.

In preferred embodiments, the mounting ring comprises two, three, or preferably four retaining tabs, and two, three, or preferably four locking tabs. In a preferred embodiment, the locking tabs extend from the retaining tabs. The mounting ring also preferably further includes a first lip extending inwardly from a first edge of the body, wherein the first lip works in conjunction with the retaining tabs folded over a portion of the first surface of the ceramic substrate at a second edge of the body to secure the ceramic substrate within the ring. The mounting ring also preferably further includes a second lip extending outwardly from a second edge of the body, wherein a portion of the wall of the exhaust vent adjacent the orifice can be clipped into place between the second lip and the locking tabs to secure the catalytic converter within the orifice of the exhaust vent.

The catalytic converter device can be used in a variety of residential, commercial, or industrial ovens, as well as other devices or systems in which catalytic conversion of a flue gas is desirable. Self-cleaning kitchen ovens are preferred. The devices are used to reduce smoke and volatile organic compounds present in an exhaust gas flowing from an oven, such as in an exhaust gas vent.

BRIEF DESCRIPTION OF THE DRAWINGS

FIG. 4A is a top view and FIG. 4B is a cross-sectional view.

DETAILED DESCRIPTION OF THE INVENTION

Figure 1A:
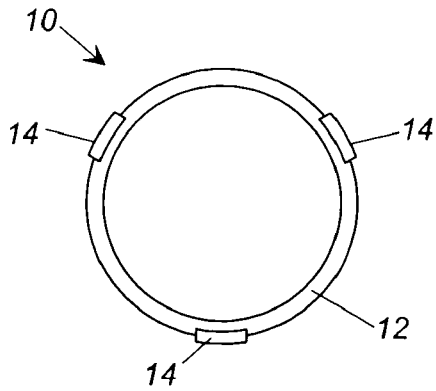
FIGS. 1A and 1B are top and bottom views, respectively, illustrating a preferred embodiment of the mounting ring of the catalytic converter device.

Ceramic-substrate catalytic converter devices with a mounting ring have been developed to secure into exhaust vents for self-cleaning ovens without the need for screws. The devices advantageously can be used with exhaust vents having widely varying shapes and dimensions, and generally can be used with any device or system in which catalytic conversion of VOCs and particulate matter, such as in a flue gas, is desirable. The present device saves space and installation time over commercially used ceramic catalytic converters, and provide increased efficiency and service life compared to screen-type catalytic converters.

The Catalytic Converter Device

The catalytic converter device includes a ceramic substrate, a catalyst coating over the substrate, and a mounting ring for holding the ceramic substrate and for securing the device into a gas vent, such as an oven vent. The catalytic converter device should be secured within an orifice of the vent such that gases flowing through the vent will pass through the apertures of the ceramic substrate. The mounting ring facilitates the ready installation and use of ceramic substrates significantly thinner than used in conventional tube assemblies, thus bringing down the material cost of the catalytic converter and enabling the ceramic substrate to be installed in smaller spaces. The catalytic converter devices described herein therefore satisfies the space and cost limitations met by screen catalyst substrates while simultaneously achieving the superior catalyst performance (e.g., longer life) provided by ceramic substrates.

While not preferred, in an alternative embodiment, the mounting ring can be adapted to secure one or more catalyst coated screens within the mounting ring. While the screens are inferior catalyst substrates compared to the ceramics, for manufacturers that persist in using screens due to actual or perceived cost benefits, the mounting ring described herein can nonetheless enhance assembly efficiency. Specifically, the mounting ring described herein can be mounted without screws, in contrast to many conventional assembly operations wherein the catalyst device is screw mounted into the oven.

The Ceramic Substrate

The ceramic substrate has a first surface, a second surface, a circumferential surface, and a plurality of apertures extending through the substrate from the first surface to the second surface. The first surface and second surface preferably are substantially flat or planar, and preferably are substantially parallel to one another. The circumferential surface preferably is circular, although essentially any other shape, such as square, oval, or triangular, can be used. The apertures preferably are circular or square, but can be other shapes as well. The apertures can extend through the substrate along axes that are perpendicular or angled with respect to the first surface, the second surface, or both surfaces. In a preferred embodiment, the apertures are patterned across the substrate in a honeycomb-like array. The particular dimensions can be readily selected based upon the specific design parameters of the vent, oven, or other device in which the catalytic converter device is to be installed and used.

In a preferred embodiment for use with self-cleaning kitchen ovens, the ceramic substrate is in the shape of a round disk. The disk preferably has a thickness of between about 1/32" and about 1/2", more preferably between about 1/8" and about 1/4", and preferably having a diameter of between about 1/2" and about 2", more preferably between about 1" and about 1 5/8". However, depending on design factors, such as the requirements of the oven manufacturer, other shapes and sizes of the ceramic substrate may be desired.

The ceramic material forming the ceramic substrate can be selected from a variety of ceramics known in the art. Representative examples of ceramic materials suitable for use as the ceramic substrate include cordierite, mullite, alumina, and silica. The particular ceramic material typically is selected to match the thermal expansion properties of the particular catalyst chosen for use. Cordierite is the preferred ceramic material for use with noble metal catalysts.

The ceramic substrate can be made using ceramic molding, cutting, and firing techniques known in the art. See, for example, U.S. Pat. No. 3,790,654 to Bagley and U.S. Pat. No. 3,801,289 to Wiley.

The Catalyst Coating

The ceramic substrate is provided with a coating that includes a catalyst. Preferred catalysts include metal catalysts, more preferably noble metal catalysts, such as platinum, palladium, rhodium, and mixtures thereof. The coating is applied using techniques known in the art to coat substantially all surfaces of the ceramic substrate to maximize the area of contact between the catalyst and the gases flowing over and through the ceramic substrate. The ceramic substrate also preferably includes a high surface area wash coat, preferably a gamma alumina wash coat, applied before or with the catalyst coating, which serves to substantially increase the surface area of the substrate. Such wash coating processes are known in the art.

The appropriate catalyst can be selected for each oven application. For self-cleaning kitchen ovens, the catalyst preferably should substantially effect complete oxidation of VOCs at about 600° F.

The Mounting Ring

The mounting ring protects the ceramic substrate during installation and maintenance of the catalytic converter, and advantageously provides quick and easy installation of the device into an oven. The mounting ring includes (i) a body in the shape of a ring; (ii) one or more retaining tabs extending from the body which secure the ceramic substrate within the ring about the circumferential surface of the ceramic substrate; and (iii) one or more locking tabs extending from the body. The one or more locking tabs are adapted to engage one or more surfaces of an exhaust vent of the oven to secure the catalytic converter within an orifice of the exhaust vent. Preferably the locking tabs secure the mounting ring by clipping, e.g., by snap-fit or slide-lock engagement, within the orifice, such that no screws are required and assembly is simplified.

By "shape of a ring" is meant that the body surrounds or forms a ring around the perimeter or circumferential surface of the ceramic substrate, whatever shape the circumference maybe. Thus, while the ring shape preferably is circular, it can be elliptical, square, rectangular, or essentially any other shape in which the substrate periphery may be made.

In a preferred embodiment, the mounting ring further includes a first lip extending inwardly from a first edge of the body. The first lip works in conjunction with the retaining tabs to secure the ceramic substrate within the ring. That is the substrate is trapped between the retaining tabs, which are bent in a position over an edge portion of the first surface of the ceramic substrate at a second edge of the body, and the first lip, which is positioned over an edge portion of the second surface of the ceramic substrate. In an alternative embodiment, retaining tabs can be bent over both the first surface and the second surface of the ceramic substrate.

In a preferred embodiment, the mounting ring further comprises a second lip extending outwardly from the second edge of the body. The second lip and locking tabs preferably are used to secure the mounting ring (and thus the catalytic converter device) within the orifice of the exhaust vent. This securing preferably is accomplished by snapping the mounting ring into the orifice such that a portion of one or more surfaces of the exhaust vent, such as those surfaces adjacent the orifice, are locked into place between the second lip and the locking tabs. In other words, the edge of the vent surrounding orifice is captured between the second lip and the locking tabs.

In preferred embodiments, the mounting ring comprises two, three, or more preferably four, retaining tabs, and two, three, or more preferably four locking tabs. In another preferred embodiment, the locking tabs extend from the retaining tabs. The retaining tabs should be spaced about the ring. For example, four folding tabs preferably are spaced 90° from one another on a circular ring-shaped body.

In a preferred embodiment, the body is in the shape of a circular ring having an internal diameter of between about 1" and 1⅝".

The mounting ring preferably is formed from a metal, although other non-metal, heat resistant materials can be used. Such materials should be substantially rigid and durable. Preferred metal materials include steels, stainless steels, aluminum, aluminized steels, and mixture or combinations thereof.

Preferred Embodiments

Figure 1B:
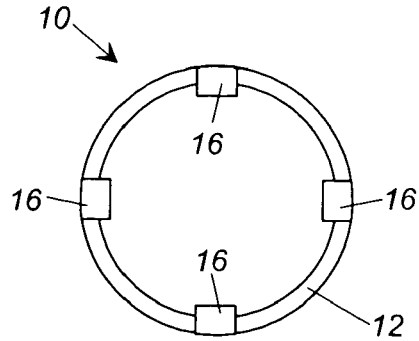
Figure 2:
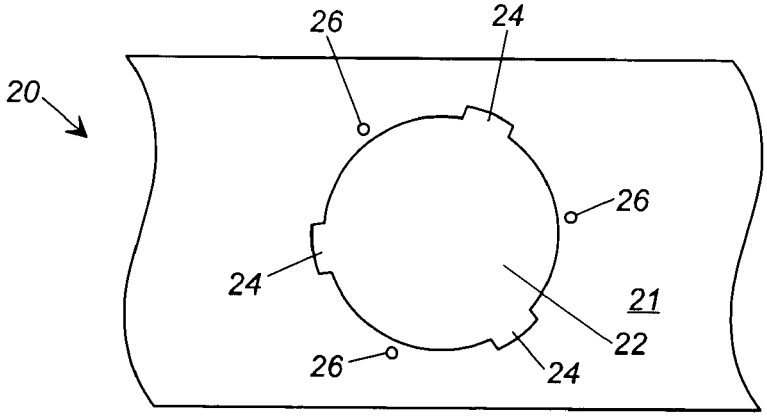
FIG. 2 is a top view of a portion of a flat tube exhaust vent having an orifice into which a preferred embodiment of the catalytic converter device can be installed.
Figure 3:
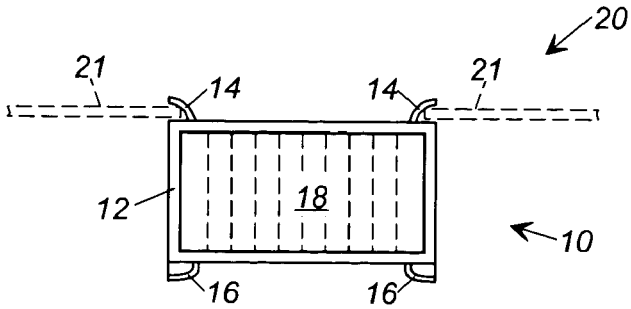
FIG. 3 is a cross-sectional view showing the mounting ring of FIGS. 1A and 1B installed, with a catalyst-coated ceramic substrate, in the orifice of the flat tube exhaust vent of FIG. 2.

The catalytic converter device can be further understood with reference to the non-limiting examples illustrated in the Figures. FIGS. 1A and 1B show top and bottom views, respectively, of mounting ring 10 having body 12, locking tabs 14, and retaining tabs 16. FIG. 2 illustrates a portion of a flat tube exhaust vent 20 having orifice 22 in vent wall 21. The orifice 22 includes cut-outs 24 corresponding to the locking tabs 14. The vent wall 21 includes a plurality of dimples 26 between the cut-outs 24 to enhance the locking function. FIG. 3 illustrates mounting ring 10 installed in orifice 22 of flat tube exhaust vent 20 and held in place with locking tabs 14. The mounting ring is shown with catalyst coated ceramic substrate 18 contained within body 12, secured by retaining tabs 16.

Figure 4A:
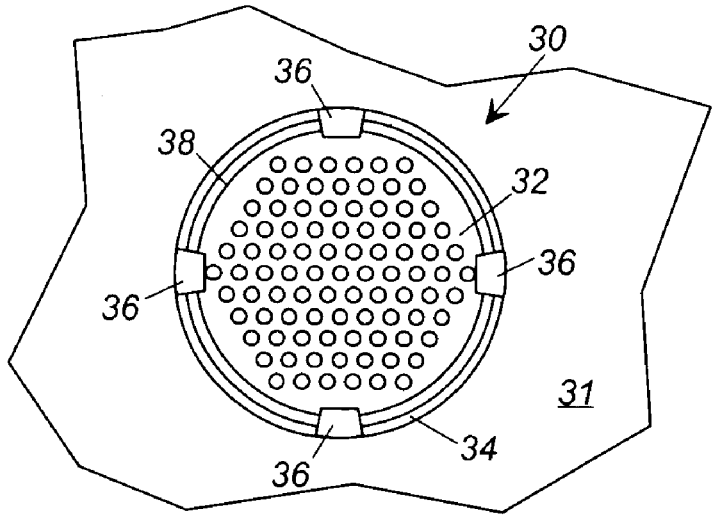
FIGS. 4A and 4B show a preferred embodiment of the catalytic converter device installed position in an orifice of a exhaust vent wall.
Figure 4B:
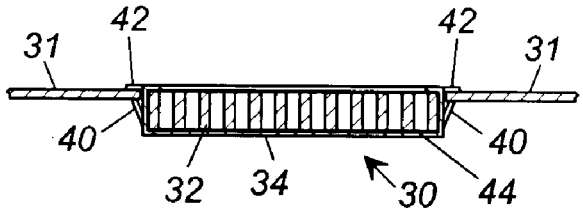
Figure 4C:
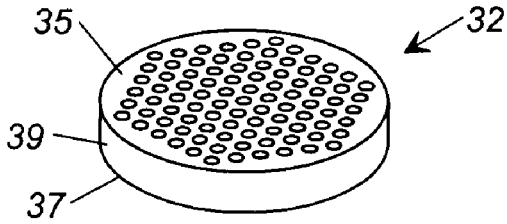
FIG. 4C is a perspective view of a preferred embodiment of the ceramic substrate, isolated from the catalytic converter device of FIG. 4A.
Figure 4D:
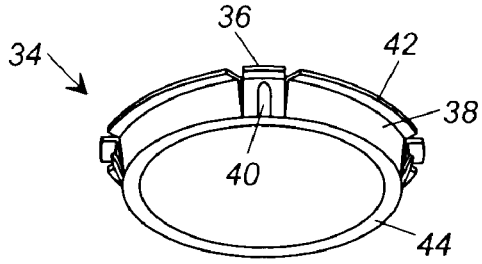
FIG. 4D is partial, perspective view of a preferred embodiment of the mounting ring, wherein the first lip is shown in its entirety, while the remainder of the mounting ring is shown in part.

FIGS. 4A and 4B show another embodiment of the catalytic converter device in an installed position. Catalytic converter device 30 is secured within vent wall 31, and includes catalyst coated ceramic substrate 32 in mounting ring 34. The mounting ring 34 includes retaining tabs 36 and first lip 44 extending from body 38. Also extending from the body 38 are locking tabs 40 and second lip 42, between which the edge of vent wall 31 is secured. FIG. 4C illustrates ceramic substrate 32 in isolation, showing first surface 35, second surface 37, and circumferential surface 39. FIG. 4D illustrates a portion of mounting ring 34, more clearly showing body 38, first lip 44, second lip 42, retaining tab 36, and locking tab 40. Locking tab 40 extends outwardly from retaining tab 36.

Making the Catalytic Converter Devices

The device preferably is made in four basic steps: the ceramic substrate is formed and fired, the ceramic substrate is coated with a wash coat and catalyst material, the mounting ring is formed, and then the catalyst-coated ceramic substrate is secured within the mounting ring. As described above, the substrate forming, firing, and coating processes are known in the art.

A representative example of the coating process includes the following steps: (i) coat the substrate with a solution or suspension of a wash coat material, such as an aqueous solution of gamma alumina; (ii) fire the wash coated substrate; (iii) coat the substrate with a solution or suspension of a catalyst; and (iv) fire the substrate again. Alternatively, steps (i) and (iii) can be combined by coating the substrate with a solution or suspension containing both wash coat material and catalyst, and then fire the substrate once.

Figure 5A:
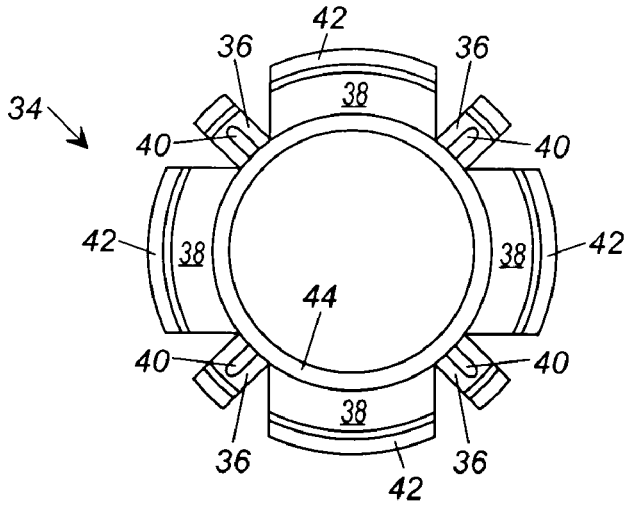
FIGS. 5A is a top view of a metal perform of a preferred embodiment of the mounting ring.
Figure 5B:
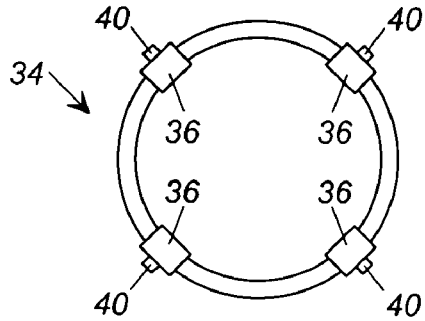
FIG. 5B is a top view of the mounting ring formed after the perform of FIG. 5A is bent into the appropriate shape.

In a preferred embodiment, the mounting ring is stamped from a sheet of metal, preferably about 0.021 inches thick, to yield a cut-out perform, as shown in FIG. 5A. The perform is then bent into the required shape, as shown in FIG. 5B. In FIGS. 5A and 5B, mounting ring 34 includes body 38, first lip 44, second lip 42, retaining tabs 36, and locking tabs 40.

The mounting ring also can be fabricated using molding and other fabrication techniques known in the art. The retaining tabs and locking tabs can be integral with the body or fabricated separately and then attached to the body, although the former is preferred.

Securing the catalyst-coated ceramic substrate into the mounting ring is simple. Preferably, the ring-shaped body first is readied to receive the substrate, either by being provided with a first lip or by bending one or more retaining tabs along the first edge, while the retaining tabs for the upper side are in their unbent position. Next, the substrate is placed within the ring via the open second edge. Then, the retaining tabs are bent over the first surface of the substrate along the second edge of the body, thereby trapping the substrate in the ring.

The mounting ring then is clipped into place in a vent, such as at an inlet orifice of an oven exhaust vent. In a preferred embodiment, the mounting ring is pushed straight into an orifice in a flat tube shape exhaust vent, wherein the orifice has a diameter slightly larger than that of the body of the mounting ring. Once inserted, the mounting ring is rotated, typically between 10 and 45°, to secure the mounting ring in place. See FIGS. 1–3 described above.

Using the Catalytic Converter Devices

The catalytic converter device is used in substantially the same manner as current commercially available catalytic converters. The catalytic converter devices can be adapted to remove smoke and VOCs from small quantities of air or other gases from a variety of sources. The converted air can be released wherever appropriate, but the catalytic converter devices are particularly useful where the air is returned indoors instead of being vented outdoors.

In a preferred embodiment, the catalytic converter device is employed in a self-cleaning kitchen oven. The catalytic converter device must be mounted in sufficient thermal proximity to the heat source of the oven so that the catalyst can reach its light-off temperature, that is, the temperature required to trigger the catalytic oxidation reaction. The oven is operated in the self-cleaning mode as directed by the oven manufacturer, which typically involves heating the oven above normal cooking temperatures to partially burn and volatilize the organic cooking residues. Convective forces cause the resulting smoke and vapors comprising VOCs and particulate matter to pass into an exhaust vent and contact the catalyst of the catalytic converter device. The catalytic converter complete the oxidation process, converting the evolved smoke and vapors into carbon dioxide and water, which then flow from the exhaust vent. Thus, smoke, VOCs, and unpleasant odors are prevented from escaping the oven and into the kitchen.

Figure 6A:
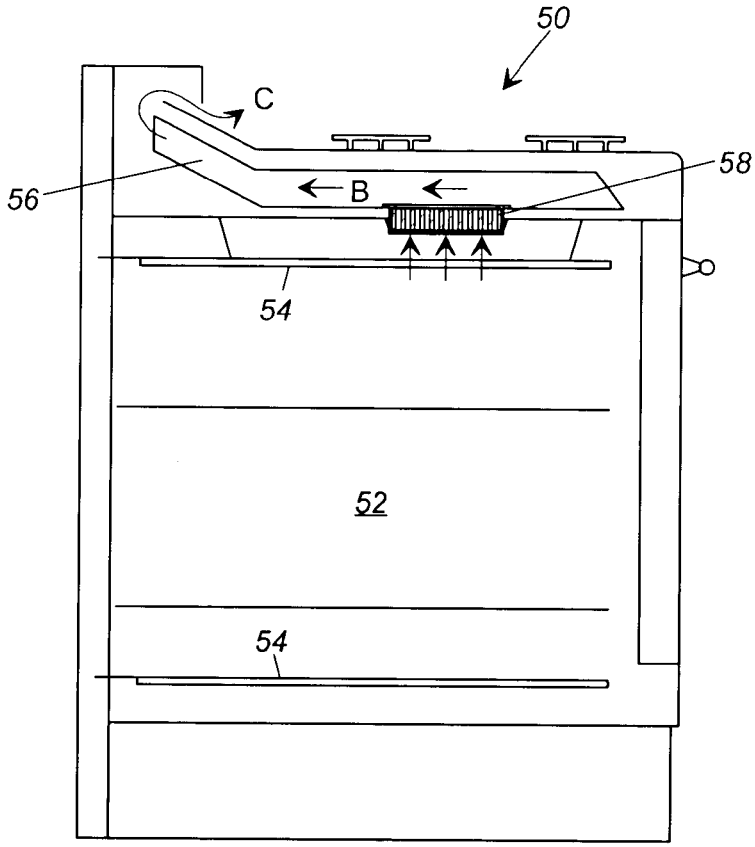
FIG. 6A is a cross-sectional view of one embodiment of a self-cleaning kitchen oven having an exhaust vent including a preferred embodiment of the catalytic converter device.
Figure 6B:
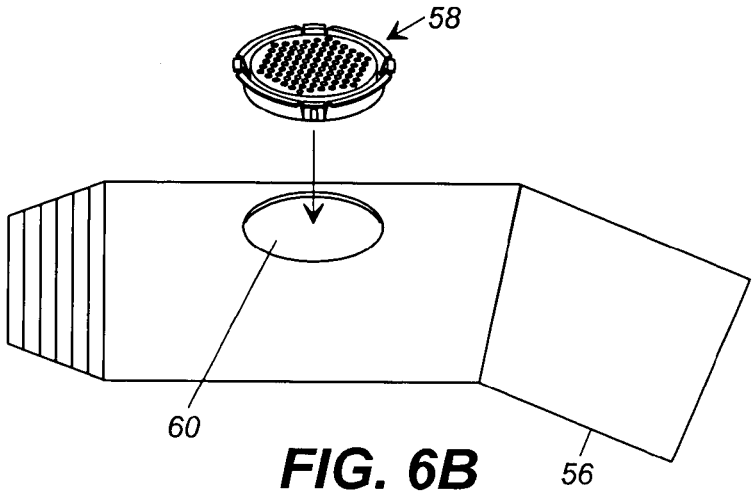
FIG. 6B is a bottom, perspective view of the exhaust vent and catalytic converter device.

A non-limiting example of a self-cleaning kitchen oven using the catalytic converter device described herein is shown in FIGS. 6A and 6B. FIG. 6A shows a kitchen range 50 including oven 52, electric heating elements 54, exhaust vent 56, and catalytic converter device 58. Arrows A, B, and C illustrate the exhaust gas flow path from the oven, through the apertures of the catalytic converter device 58, through the exhaust vent 56, and finally out of the kitchen range 50. FIG. 6B illustrates the bottom of surface of the exhaust vent 56, and shows the orifice 60 wherein the catalytic converter device 58 is clipped.

The catalytic converter device also can be used in other types of ovens, such as commercial and laboratory ovens. For example, the catalytic converter device can be used with the dental mold ovens used to thermally remove wax from various dental prosthetics made by wax molds. The process of burning off the wax results in VOCs being evolved. These VOCs can be oxidized and eliminated using the present catalytic converter device, preventing their release into dentists' laboratories and offices.

Those skilled in the art will recognize, or be able to ascertain using no more than routine experimentation, many equivalents to the specific embodiments of the invention described herein. The references cited herein are hereby incorporated by reference.

We claim:

1. A catalytic converter device for use in an oven vent comprising:

a ceramic substrate having a first surface, a second surface, a circumferential surface, and a plurality of apertures extending through the substrate from the first surface to the second surface;

a material coating the ceramic substrate, wherein the coating material comprises a catalyst; and a mounting ring comprising (i) a body in the shape of a ring, the body having an upper edge portion and a distal lower edge portion;

(ii) one or more retaining tabs extending inwardly from the upper edge portion and at least one first lip extending inwardly from the lower edge portion, the one or more retaining tabs and the at least one first lip cooperating to secure the ceramic substrate therebetween within the ring about the circumferential surface of the ceramic substrate; and (iii) one or more locking tabs extending outwardly from the body and at least one second lip extending outwardly from the body, wherein an edge of an orifice in the oven vent can be locked into place between the one or more locking tabs and the at least one second lip to secure the catalytic converter device within the orifice of the oven vent such that gases flowing through the oven vent will pass through the apertures of the substrate.

2. The catalytic converter device of claim 1, wherein the ceramic substrate has a thickness of between about 1/32 inch and about 1/2 inch.

3. The catalytic converter device of claim 2, wherein the ceramic substrate is in the shape of a round disk.

4. The catalytic converter device of claim 3 wherein the ceramic substrate has a diameter of between about 1/2 inch and about 2 inches.

5. The catalytic converter device of claim 3, wherein the ceramic substrate has a thickness of about 1/4 inch and a diameter of about 1 1/4 inches.

6. The catalytic converter device of claim 1, wherein the ceramic substrate comprises cordierite.

7. The catalytic converter device of claim 1, wherein the ceramic substrate comprises a wash coat.

8. The catalytic converter device of claim 1, wherein the catalyst is a noble metal catalyst.

9. The catalytic converter device of claim 8, wherein the noble metal catalyst is selected from the group consisting of platinum, palladium, rhodium, and mixtures thereof.

10. The catalytic converter device of claim 1, wherein the mounting ring is formed from a metal selected from the group consisting of steels, stainless steels, aluminum, aluminized steel, mixtures thereof, and combinations thereof.

11. The catalytic converter device of claim 1, wherein the mounting ring comprises two, three, or four retaining tabs.

12. The catalytic converter device of claim 11, wherein the mounting ring comprises four retaining tabs.

13. The catalytic converter device of claim 1, wherein the mounting ring comprises two, three, or four locking tabs.

14. The catalytic converter device of claim 13, wherein the mounting ring comprises four locking tabs.

15. The catalytic converter device of claim 1, wherein the locking tabs extend from the retaining tabs.

16. The catalytic converter device of claim 1, wherein:

the catalyst is a noble metal selected from the group consisting of platinum, palladium, rhodium, and mixtures thereof;

the ceramic substrate has a thickness of about 1/4 inch and a diameter of about 1 inch; and the mounting ring is formed from a metal and comprises four retaining tabs and four locking tabs, with one locking tab extending from each retaining tab.

17. An oven comprising the catalytic converter device of claim 1.

18. The oven of claim 17 wherein the oven is a self-cleaning kitchen oven.

19. A vent for venting gases from an oven, comprising:

a tube having an inlet orifice and an outlet; and the catalytic converter device of claim 1 secured within the inlet orifice, wherein the one or more locking tabs are engaged with one or more surfaces of the tube adjacent the inlet orifice.

20. The device of claim 1, wherein the retaining tabs and the locking tabs are integral with the body.

21. A catalytic converter device for use in an oven vent comprising:

one or more screens formed of a plurality of woven metal threads, defining a plurality of apertures therebetween;

a material coating the screens, wherein the coating material comprises a catalyst; and a mounting ring comprising (i) a body in the shape of a ring, the body having an upper edge portion and a distal lower edge portion;

(ii) one or more retaining tabs extending inwardly from the upper edge portion and at least one first lip extending inwardly from the lower edge portion, the one or more retaining tabs and the at least one first lip cooperating to secure the one or more screens therebetween within the ring; and (iii) one or more locking tabs extending outwardly from the body and at least one second lip extending outwardly from the body, wherein an edge of an orifice in the oven vent can be locked into place between the one or more locking tabs and the at least one second lip secure the catalytic converter device within an orifice of the vent such that gases flowing through the vent will pass through the apertures of the one or more screens.

22. The device of claim 21, wherein the locking tabs extend from the retaining tabs.

23. The device of claim 21, wherein the retaining tabs and the locking tabs are integral with the body.

* * * * *